United States Patent [19]

Chapell

[11] Patent Number: 4,779,066

[45] Date of Patent: Oct. 18, 1988

[54] MULTI-POSITION SWITCH

[75] Inventor: Harry F. Chapell, Maynard, Mass.

[73] Assignee: Sage Laboratories, Inc., Natick, Mass.

[21] Appl. No.: 40,052

[22] Filed: Apr. 20, 1987

[51] Int. Cl.[4] ..... H01P 1/12

[52] U.S. Cl. ..... 333/105; 333/262; 335/5; 200/153 S

[58] Field of Search ..... 333/105, 262; 335/4, 335/5; 200/153 S

[56] References Cited

U.S. PATENT DOCUMENTS

| | | | |
|---|---|---|---|
| 3,182,270 | 5/1965 | Horton | 333/105 |
| 4,298,847 | 11/1981 | Hoffman | 333/105 |
| 4,496,919 | 1/1985 | Fournier et al. | 333/105 X |
| 4,697,056 | 9/1987 | Hoffman | 333/105 X |

FOREIGN PATENT DOCUMENTS

| | | | |
|---|---|---|---|
| 0211541 | 2/1987 | European Pat. Off. | 333/105 |

*Primary Examiner*—Eugene R. LaRoche
*Assistant Examiner*—Seung Ham
*Attorney, Agent, or Firm*—Wolf, Greenfield & Sacks

[57] ABSTRACT

In a multi-position microwave switch, a terminating impedance is associated with the center conductor of each port of the switch. When a port is selected, the resistor is pushed into the conductor by the blade completing the RF path to the selected position. When the position is not selected, the resistor is pushed out of the conductor until it contacts a grounded portion of the switch. An alternate embodiment of the invention employs a flexible terminating impedance secured to the blade.

48 Claims, 5 Drawing Sheets

22
12
24
4
4
16
24
24

24
12
27
26
16
15
10
20
29
28
18

7
7

Fig. 8
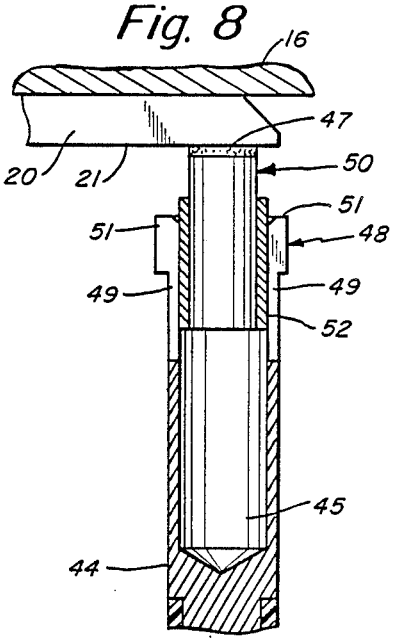
Fig. 9
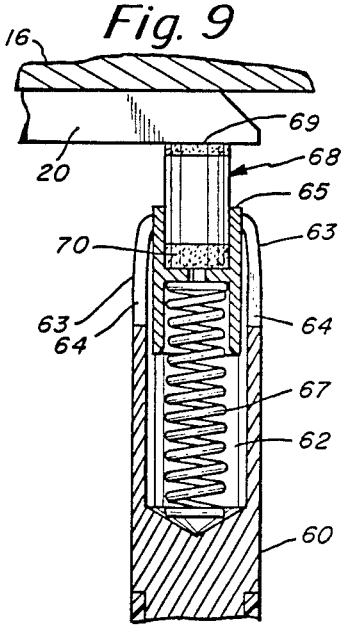
Fig. 10
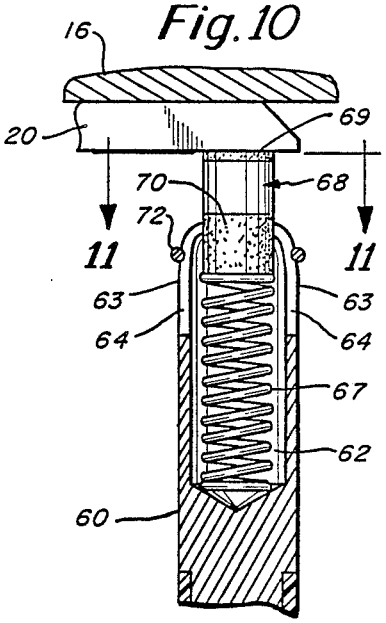
Fig. 11
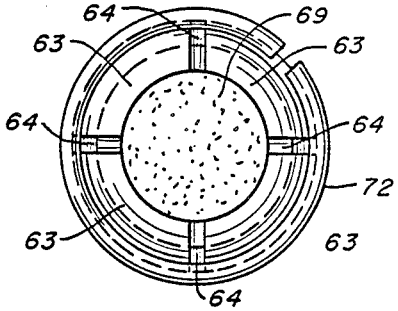
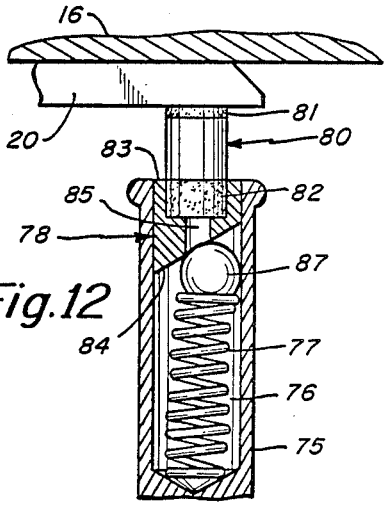
Fig. 12

MULTI-POSITION SWITCH

BACKGROUND OF THE INVENTION

1. Field of the Invention

The present invention relates very generally to microwave devices and pertains, more particularly to electro-mechanical multi-position RF switches. Even more particularly, the invention relates to a multi-position microwave switch with improved internal termination.

2. Prior Art Background

There are many different types of multi-position switches provided with a matched termination to the unselected port of the switch. Typical patents that cover multi-position microwave switches include U.S. Pat. No. 2,958,054 to Concelman, U.S. Pat. No. 3,182,270 to Horton; and U.S. Pat. No. 4,298,847 to Hoffman.

The aforementioned Hoffman construction is typical of more recent switch constructions requiring the use of a separate blade and associated components that are necessary for overall operation. These extra components make for a more complicated and expensive switch construction.

Accordingly, it is an object of the present invention to provide a more simplified multi-position switch construction that eliminates the need for a separate blade and associated blade motion mechanism.

Another object of the present invention is to provide an improved multi-position microwave switch in which the terminating resistor, in accordance with one embodiment of the invention is essentially formed as part of or within the center conductor of each output port of the switch, in which case the terminating resistor itself is essentially moveable between two different positions, one in which the resistor is shorted and thus out of the circuit.

SUMMARY OF THE INVENTION

To accomplish the foregoing and other objects, features and advantages of the invention, there is provided an improved multi-position switch in which there is provided a preferred low inductance resistor for terminating each of the output ports of the switch. The terminating resistor is disposed essentially inside of or associated with the center conductor of each output port. When a port is selected, the terminating resistor is pushed into the conductor by the blade completing the RF path to the selected position. The blade makes direct contact to the center conductor and the terminating resistor is not in the circuit. When a port is not to be selected, the resistor is pushed out of the conductor by a spring or the like until the resistor hits a grounded portion of the switch. It may contact the RF blade which is then disposed against an opposite housing wall, thus making contact. The resistor thus terminates the position in a matched impedance.

More particularly, in accordance with the invention, there is provided a multi-position microwave switch that comprises a substantially cylindrical housing having a base and a cover plate with a cavity of uniform height disposed therein. The cavity has a central portion and a plurality of spaced radial portions of substantially uniform width extending radially therefrom. A central connector is mounted in the base with its inner conductor extending into the coaxially with the central portion. A plurality of peripheral connectors are provided, each mounted in the base substantially parallel to the central connector with their inner conductors extending into the peripheral end of one of the respective radial portions. A plurality of terminating resistors are provided. These are equal in number to the plurality of peripheral connectors. Each of the resistors have an impedance equal to the characteristic impedance of the central connector. A plurality of conductor blades are provided equal in number to the plurality of peripheral connectors. Each of these conductor blades are disposed in one of the radial portions and are of a length sufficient to connect the inner conductor of the central connector to the inner conductor of the peripheral connector when in a first of two switchable position, and urged to be grounded when in a second of the switchable positions. Actuating means are provided disposed above the base cavity for selectively switching the conductor blades between these two switchable positions. There is provided a plurality of terminating resistor support means equal in number to the plurality of terminating resistors. Each of these support means is disposed over a respective peripheral connector and is adapted to support the terminating resistor in either of two positions including a first position corresponding to the conductor blade first switchable position in which the conductor blade directly contacts the inner conductor of ther peripheral connector, bypassing the terminating resistor, and a second position, corresponding to the conductor blade second switchable position, in which the conductor blade is coupled via the terminating resistor to the inner conductor of the peripheral connector.

The terminating resistors as well as the support means therefor may take on varied forms. The support means may be in the form of a support sleeve or a separate slideable member may be employed. Preferably, a spring is used to bias the terminating resistor against the blade. However, in an alternate embodiment of the invention, the terminating resistor may be affixed to the blade in which case the biasing spring may be unnecessary. In still another embodiment of the present invention, the support means for the terminating resistor may be of fingered construction. In a further embodiment of the present invention, the terminating resistor may be in the form of a flexible member having conductive ends and a centrally disposed flexible resistive portion. In this embodiment, the flexible member may be secured to the blade.

BRIEF DESCRIPTION OF THE DRAWINGS

Numerous other objects, features and advantages of the invention should now become apparent upon a reading of the following detailed description taken in conjunction with the accompanying drawing, in which:

FIG. 8 is a fragmentary cross-sectional view of an alternate embodiment of the invention in which the terminating resistor is secured to the blade thus eliminating the need for a biasing spring;

FIG. 9 is a fragmentary cross-sectional view of still another embodiment of the present invention;

FIG. 10 is a fragmentary cross-sectional view of another embodiment of the present invention;

FIG. 11 is a cross-sectional view taken of line 11—11 of FIG. 10;

FIG. 12 is a fragmentary cross-sectional view of still a further embodiment of the present invention with the terminating resistor in the circuit;

DETAILED DESCRIPTION

In accordance with the present invention there is provided a low inductance resistor which is essentially disposed, in a preferred embodiment, inside the center conductor of each port of the switch. When a port is selected, the resistor is pushed into the conductor by the actuating blade thus completing the RF path to the selected position. The blade makes direct contact to the center conductor and the resistor is essentially out of the circuit.

When a particular position is not selected, the resistor is pushed out of the conductor, in a preferred embodiment with the use of a spring, until the resistor contacts a grounded portion of the switch. The resistor at one end contacts the blade which in turn is disposed against an opposite wall in the housing thus providing the desired grounding. The resistor thus terminates the position in a matched impedance.

Figure 1:
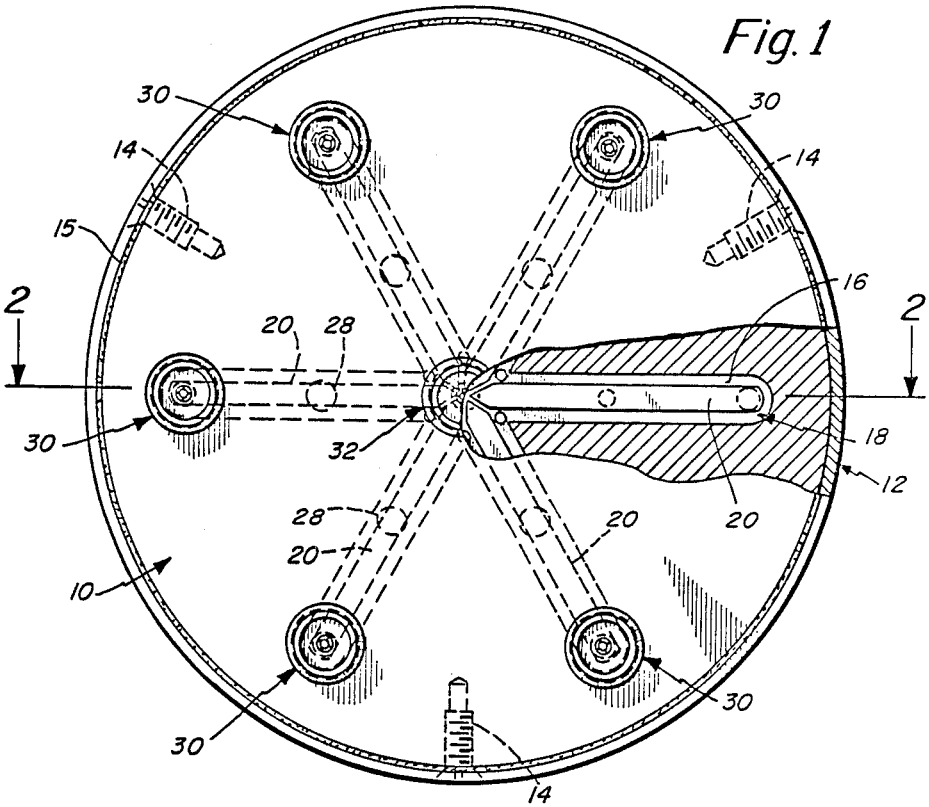
FIG. 1 is a bottom plan view of a first embodiment of a multi-position microwave switch and partially cut away to illustrate further details of the blade and channel construction.
Figure 2:
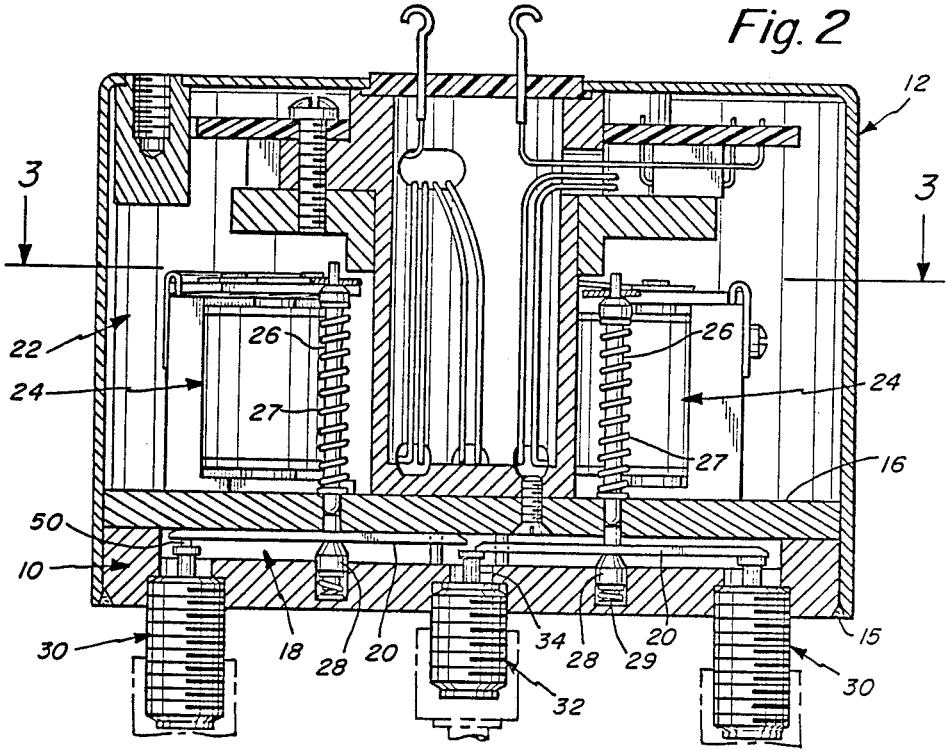
FIG. 2 is a cross-sectional view taken along line 2—2 of FIG. 1 showing further details of the multi-position microwave switch illustrating one of the positions being selected and one unselected.

Reference is now made to the drawings and in particular to a first embodiment of the invention illustrated in FIGS. 1–4. Further details of this embodiment to the invention are set forth in FIGS. 5–7. The invention is described herein in the form of a multi-position coaxial microwave switch that is comprised of a base 10 and a cover 12. A series of screws 14 illustrated in phantom in FIG. 1 may be employed for securing the cover 12 to the base 10. A sealant may be provided to secure the base and cover. This is illustrated in FIGS. 1 and 2 by the silicone sealant 15.

Figure 3:
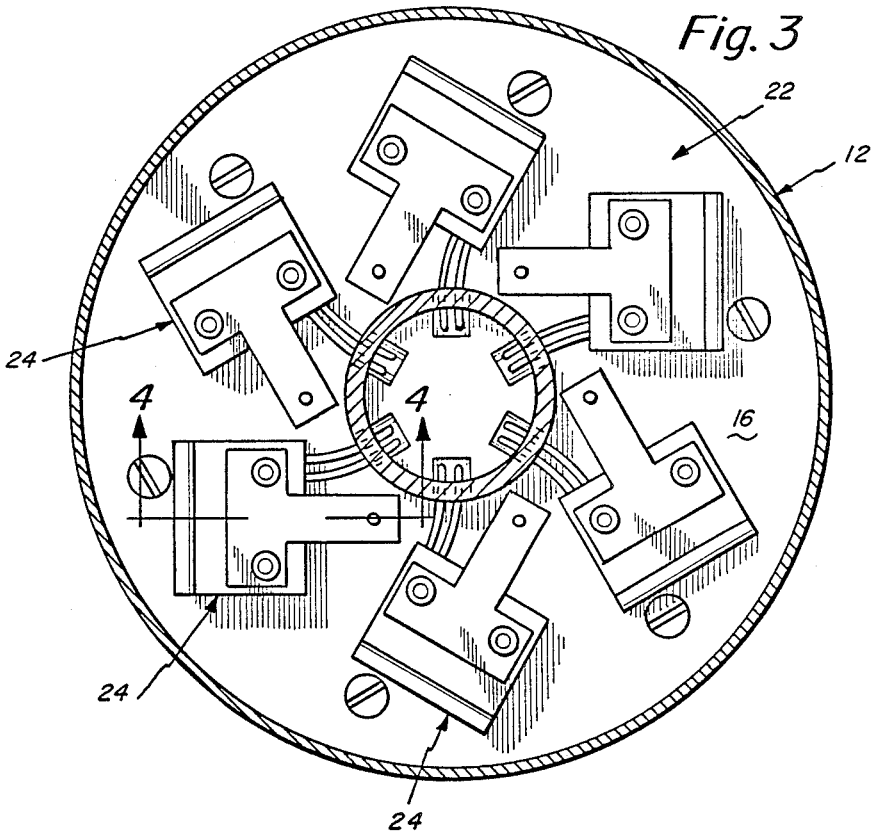
FIG. 3 is a cross-sectional view taken along line 3—3 of FIG. 2 illustrating further details of the upper portion of the switch in the area of the selection solenoids.

Part of the switch construction is a flat plate 16 disposed over the base 10 and forming therebetween a cavity 18 in which are disposed the plurality of contacting blades 20. Above the flat plate 16 is a compartment 22 in which are disposed a plurality of selection solenoids 24. Each of the solenoids 24 have wires associated therewith, such as illustrated in FIG. 3. Each of these solenoids are individually selectable to control one of the blades 20 associated therewith. In the particular embodiment illustrated in FIGS. 1–4, there are six blades associated with six output ports of the switch and there are also of course six associated solenoids.

Figure 4:
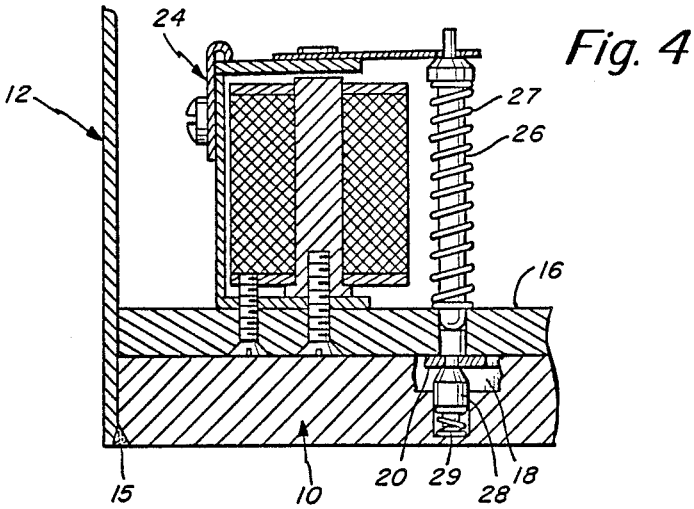
FIG. 4 is a cross-sectional view taken along line 4—4 of FIG. 3 showing further details of the solenoid selection mechanism.

As illustrated in the more detaileld diagram of FIG. 4, each of the solenoids 24 operates a push rod 26 having disposed thereabout a spring 27. The push rod 26 operates a retainer 28. Note the return spring 29 at the bottom of retainer 28. In the particular view of FIG. 4, the solenoid is de-energized and thus the push rod 26 is in its more uppermost position. The return spring 29 thus biases the blade 20 against the plate 16. This position is the position illustrated in the left in FIG. 2. The blade 20 is thus grounded against the plate 16 and this forms the means, as to be discussed in further detail hereinafter, by which the terminating resistor is grounded.

Reference is now again made to FIGS. 1 and 2 for an illustration of coaxial connectors. These include six peripheral coaxial connectors 30 and a central coaxial connector 32. The central coaxial connector 32 may be substantially of conventional design including a center conductor 34 and an outer conductor 36. In the cross-sectional view of FIG. 2, it is noted that the right hand blade 20 is shown contacting the center conductor 34. It is thus this blade 20 that is the selected blade and that is adapted to provide direct conductive connection between the central connector 32 and the selected peripheral connector 30. The left hand blade in FIG. 2 is one of the unselected blades and in this instance, the blade 20 is in its upper position against the plate 16 with the terminating resistor in the circuit as to be described hereinafter.

Figures 5, 6, 7:
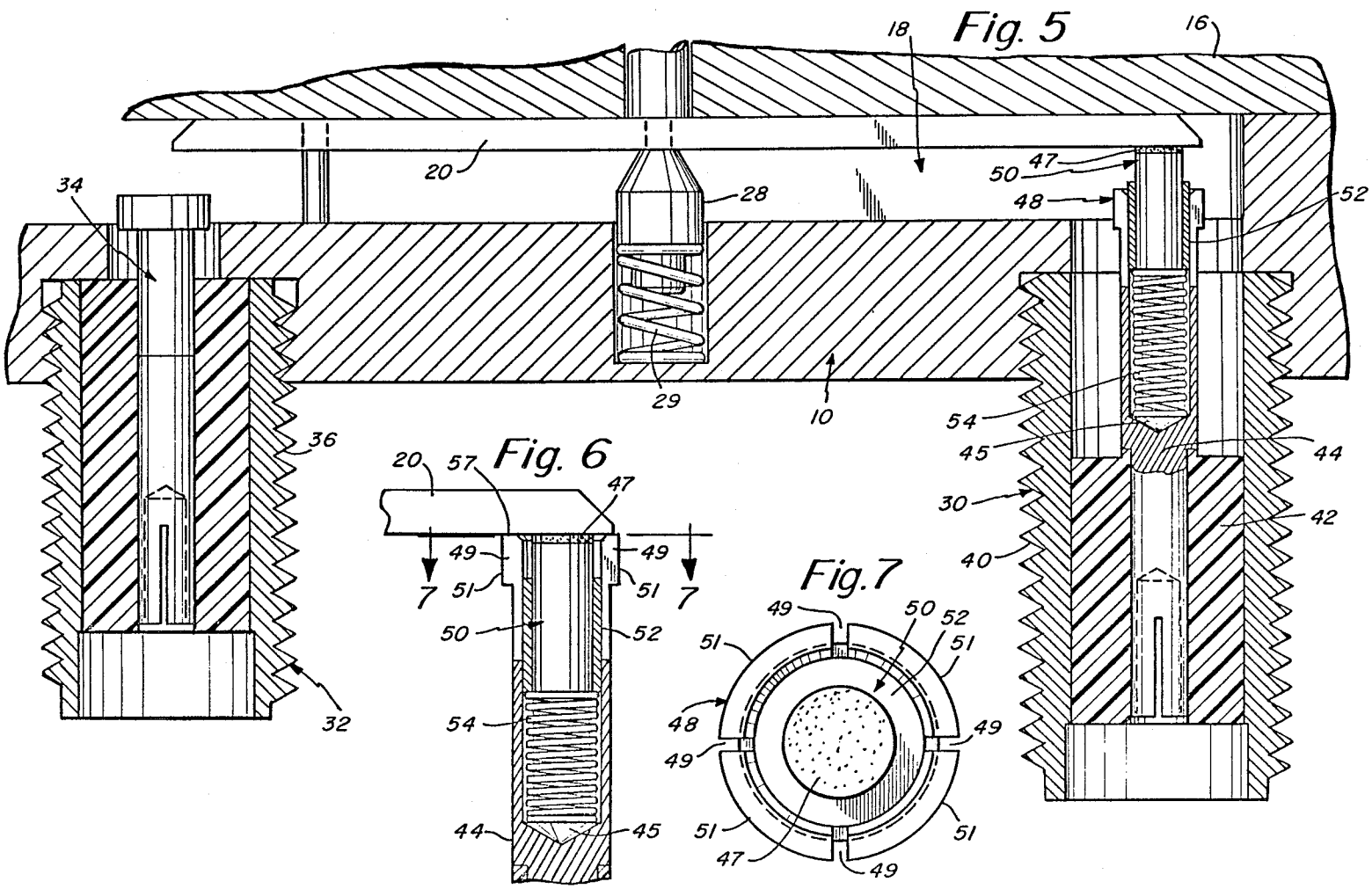
FIG. 5 is an enlarged fragmentary view of the embodiment of the invention illustrated in FIGS. 1–4 showing an unselected switch blade with the terminating resistor in the circuit.
FIG. 6 is a fragmentary view illustrating the opposite position of the resistor, out of the circuit, with the blade having direct conductive contact with the resistor support means.
FIG. 7 is a cross-sectional view taken along line 7—7 of FIG. 6.

The improved terminating resistor concept of the present invention is illustrated in one embodiment in FIG. 5. In FIG. 5 note the peripheral connector which may be partially of conventional design including in particular the outer conductor portion illustrated at 40. There is also a dielectric sleeve 42 that provides electrical isolation between the outer conductor 40 and the inner conductor 44.

In accordance with the preferred concepts of the present invention the inner conductor 44 has a cavity 45 for receiving the terminating resistor 50. In the embodiment of FIG. 5 the resistor 50 is predominantly constructed of a resistive material having a desired characteristic impedance and has an ohmic contact at the top end thereof as illustrated at 47 in FIG. 5. The terminating resistor 50 is supported in the sleeve 52. The sleeve 52 may be soldered or secured to the resistor 50 by other appropriate means and thus in this embodiment the resistor and sleeve translate together.

The terminating resistor 50 is supported within the recess 45 in a position so that it is biased upwardly. This biasing is carried out by means of the coil spring 54. In FIG. 5 the coil spring 54 is shown in its extended position.

The inner conductor 44 is provided at its top end 48 with four slots 49 defining separate fingers 51. In this regard, refer to the plan view of FIG. 7 for an illustration of the slots 49 and associated fingers 51. The arrangement of slots and fingers provides some amount of resiliency and the top of the inner conductor permitting the resistor 50 and its associated support sleeve 52 to easily translate up and down in the recess 45 under the bias of the coil spring 45.

In the cross-sectional view of FIG. 5 the terminating resistor 50 is shown in its in-circuit position. This is a position in which the blade 20 is unselected. Note in FIG. 5 that the blade 20 does not make any contact to the inner conductor 34 associated with the centrally disposed connector. In this unselected position it is desired to have the switch port terminated and thus the terminating resistor 50 is in the circuit. The circuit is completed from the inner conductor 44, through sleeve 52, through the resistor 50, to the ohmic contact 47, and through the conductive blade 20 to the conductive housing at flat plate 16. As indicated previously, the resistor 50 is biased to this position by the spring 54. It is furthermore noted that there is no direct contact in FIG. 5 from the blade 20 to any part of the inner conductor 44.

Now, FIG. 6 shows the alternate position of the blade 20, namely a position in which the blade 20 has moved downwardly against the bias of spring 29. When this occurs the resistor 50 is pushed further into the cavity 45 compressing the spring 54 as noted in FIG. 6. The sleeve 52 moves with the resistor and when the blade 20 is in its full downward position the bottom of the blade surface 20 contacts the top end 48 of the inner conductor 44 at the fingers 51. This contact occurs along the line 57 in FIG. 6. This means that the resistor 50 is essentially out of the circuit. One may consider it to essentially be short circuited but the point is that direct electrical conductivity occurs from the inner conductor 44 directly to the blade 20. In the downward position of the blade 20, of course, there is also contact at the other end of the blade with the inner conductor of the central connector.

An alternate embodiment of the invention is illustrated in FIG. 8. This embodiment is similar to the embodiment illustrated in FIGS. 5–7 and thus in FIG. 8 like reference characters are used. For the sake of simplicity, in FIG. 8 as well as in FIGS. 9–12, complete details of the connector are not illustrated. Reference may be made, however, to FIG. 5 in this regard.

Thus, in FIG. 8 there is an inner conductor 44 having a cavity 45. The top end of the inner conductor at 48 has the finger and slot arrangement as illustrated in FIG. 7. The terminating resistor 50 has an ohmic contact 47 at its top end, and also has an ohmic contact at the bottom end. The resistor 50 is fixedly supported within the support sleeve 52. In this particular embodiment it is noted that there is no spring provided within the cavity 45. In this particular embodiment the ohmic contact 47 is fixedly secured to the underside surface 21 of the blade 20. This fixing of the ohmic contact 47 and thus the entire resistor 50 to the blade 20 may be carried out by soldering or with the use, for example, a conductive epoxy.

In the particular embodiment of FIG. 8, the operation is substantially the same as previously described in connection with FIGS. 5 and 6. In FIG. 8 the terminating resistor 50 is shown in its upper position which is its in-circuit position. This is when the blade 20 is against the plate 16. Because the resistor 50 is secured to the blade 20 there is no need to use a biasing spring.

When the blade 20 moves downwardly, then the resistor and its associated support sleeves simply move into the cavity 45 and again contact occurs between the top of the inner conductor 44 and the underside surface 21 of the blade 20. This was illustrated previously in FIG. 6.

FIG. 9 shows still a further embodiment of the present invention including an inner conductor 60 having a cavity 62. The inner conductor 60 has at its top end a slot and finger arrangement similar to that illustrated hereinbefore. FIG. 9 shows the fingers 63 and the slots 64. In this regard also refer to the plan view of FIG. 11. The fingers 63 support an H-shaped sleeve 65 having a lower recess for receiving the spring 67 and an upper recess for receiving the terminating resistor 68. In the embodiment of FIG. 9 it is noted that the terminating resistor 68 has both an upper ohmic contact 69 as well as a lower ohmic contact 70. The construction of sleeve illustrated in FIG. 9 strengthens the resistor and provides a positive securing means for retaining the terminating resistor 68.

It is noted in FIG. 9 that the fingers 63 are inwardly turned at their top ends. This provides essentially point contact to thus provide low drag regarding movement of the resistor and associated sleeve.

In FIG. 9 the terminating resistor 68 is constructed of a resistive material. The ohmic contact 69 may be formed by a gold plated contact area. The ohmic contact 70 may be in the form of a metallized ring. The basic resistor itself may be a ceramic resistor having a resistive coating thereon.

Reference is now made to FIG. 10 for still another embodiment of the present invention. The basic inner conductor structure in FIG. 10 is substantially the same as illustrated in FIG. 9. This includes the inner conductor 60 with the cavity 62 and with, at its top end, the finger 63 and slot 64 combination. Also refer to the cross-sectional view taken along line 11—11 of FIG. 10 illustrating the slot and finger arrangement.

The one thing that has been added to FIG. 10 is the use of a spring 72. This provides pressure inward on the fingers 63 to provide a good ohmic contact between the terminating resistor and the inner conductor 60.

In the embodiment of FIG. 10, the terminating resistor may be of metal film or carbon film construction. The ohmic contacts may be formed by metallization or by metal plating such as by gold or chrome plating.

FIG. 12 shows still a further embodiment of the present invention including an inner conductor 75 having a cavity 76 that contains the biasing spring 77. In this embodiment there is provided a terminating resistor 80 having an upper ohmic contact 81 and a lower ohmic contact 82. The terminating resistor 80 is supported within a sleeve 78 having a flat top surface at 83 and a tapered lower surface at 84. There is also a passage 85 in the sleeve 78. In addition to the spring 77, in this embodiment there is also provided a ball 87. The combination of the ball 87 and the sloped wall 84 provides some form of side contact. This is the contact between the sleeve and the inner conductor. Of course, the combination of the spring 77 and the ball 87 also provides the necessary upward biasing force on the terminating resistor 80.

Figure 13:
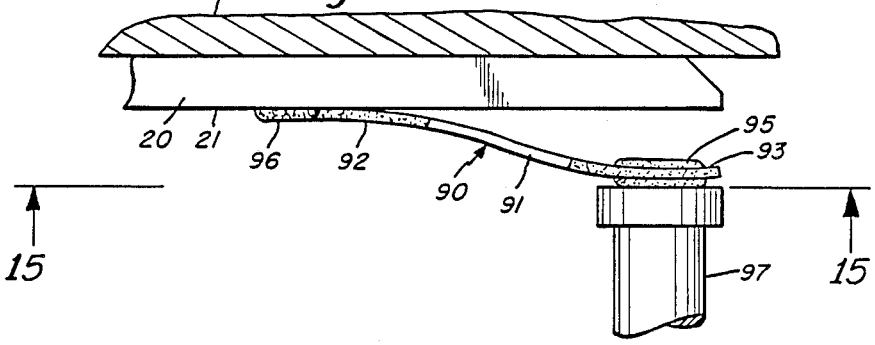
FIG. 13 illustrates still a further alternate embodiment of the invention in a fragmentary side elevation view employing a flexible member for forming the terminating resistor with the terminating resistor in the circuit.
Figure 14:
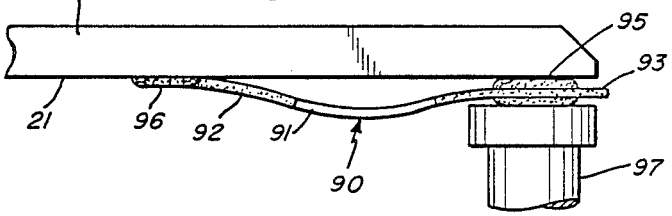
FIG. 14 is a fragmentary side elevation view illustrating the terminating resistor in a position in which it is short-circuited.
Figure 15:
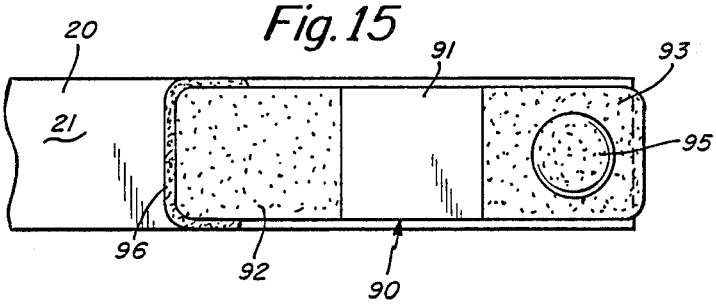
FIG. 15 is a plan view of the embodiment illustrated in FIGS. 13 and 14.

A last embodiment of the invention is illustrated in FIGS. 13–15. In this embodiment the terminating resistor element is illustrated at 80. In this embodiment the terminating resistor is in the form of a flexible member. The base material of the resistor may be plastic and it may have deposited thereon both resistive and metallized layers. The plastic provides the support and functions as a carrier for the thin resistive and metalized film. The resistive and metalized layers provide the necessary resistance and ohmic contact. The terminating resistor thus is illustrated as having a central section 91 that is resistive and that may be formed by the deposition of a resistive layer on the plastic. There are also provided opposite ohmic contact ends 92 and 93. These parts of the terminating resistor may be formed by the deposition of a metal such as tin or gold. There is also preferably provided a high conductivity contact button 95. Associated with the end 93.

In this flexible member embodiment of the invention illustrated in FIGS. 13–15, it is noted that there is illustrated an inner conductor 97 and also it is noted that the end 92 of the flexible member is soldered at 96 to the underside surface 21 of the blade. Thus, the terminating resistor in this embodiment is actually secured to the blade 20 and has its opposite end free. Actually, the button 95 may be fixedly secured to the inner conductor 97.

In FIG. 13 the blade is shown in its uppermost position which is a position in which the port is to be terminated. Thus, it is noted that conductivity occurs from the inner conductor 97 by way of the terminating resistor 90 to the blade 20 and from their to the plate 16.

In the position illustrated in FIG. 14 the blade 20 has been moved downwardly to a port selected position and in this instance the blade 20 has direct electrical conductive contact via the button 95 with the inner conductor 97.

In connection with the embodiment illustrated in FIGS. 13–15, it is to be noted that in an alternate embodiment thereof, not specifically illustrated herein, the flexible terminating resistor 90 may be secured to the inner conductor 97 rather than being secured to the blade 20. In this instance, the flexible resistor 90 would have to be biased at its pre-end against the blade 20. In still a further embodiment of the invention the resistor 90 may be secured at both ends to the respective blade and inner conductor.

In the embodiments that have been disclosed, some of the drawings illustrate the use of a top ohmic contact. It is understood that there is, of course, an ohmic contact at both ends of the terminating resistor so that proper conductive coupling thereof is carried out.

Having now described a limited number of embodiments of the invention, it should now be apparent to those skilled in the art that numerous other embodiments and modifications thereof are contemplated as falling within the scope of the present invention as defined by the appended claims.

What is claimed is:

1. A multi-position microwave switch comprising:

a substantially cylindrical housing having a base and a cover plate with a cavity of uniform height disposed therein, said cavity having a central portion and a plurality of spaced radial portions of substantially uniform width extending radially therefrom;

a central coaxial connector mounted in said base with its inner conductor extending into and coaxially with said central portion;

a plurality of peripheral coaxial connectors each being mounted in said base substantially parallel to said central connector with its innner conductor extending into the peripheral end of one of said radial portions;

a plurality of termination resistors equal in number to said plurality of peripheral connectors, each said resistor having an impedance equal to the characteristic impedance of said central connector;

a plurality of conductor blades equal in number to said plurality of peripheral connectors, each disposed in one of said radial portions and of a length sufficient to electrically conductively bridge between said inner conductor of said central connector and said inner conductor of said peripheral connector when in a first of two switchable positions, and urged to be out of bridging contact between said inner conductor of said central connector and said inner conductor of said peripheral connector when in a second of said switchable positions;

actuating means disposed above said base cavity for selectively switching said conductor blades between said first and second switchable positions;

and a plurality of termination resistor support means equal in number to said plurality of termination resistors, each disposed over a respective peripheral connector and adapted to support said termination resistor in either of two positions, including a first position, corresponding to said conductor blade first switchable, position in which said conductor blade directly contacts the inner conductor of said peripheral connector by-passing said termination resistor, and a second position, corresponding to said conductor blade second switchable position, in which said conductor blade is coupled via said termination resistor to the inner conductor of said peripheral connector.

2. A multi-position microwave switch as set forth in claim 1 wherein said resistor support means includes a retainer slideably received in a recess in the inner conductor of said peripheral coaxial connector.

3. A multi-position microwave switch as set forth in claim 2 wherein said retainer is slotted to form multiple support fingers.

4. A multi-position microwave switch as set forth in claim 2 including a biasing spring in said recess to urge the resistor out of the recess.

5. A multi-position microwave switch as set forth in claim 1 wherein said resistor support means includes an inner conductor portion.

6. A multi-position microwave switch as set forth in claim 5 including a biasing means in said inner conductor portion for biasing said resistor toward its associated blade.

7. A multi-position microwave switch as set forth in claim 1 wherein said resistor support means includes recess defining means in said inner conductor for receiving said termination resistor.

8. A multi-position microwave switch as set forth in claim 7 including means for securing the termination resistor to its associated blade.

9. A multi-position microwave switch as set forth in claim 1 wherein said resistor support means includes a retainer having a flat top and sloped bottom.

10. A multi-position microwave switch as set forth in claim 9 further including a biasing spring and overlying ball for urging the resistor toward its associated blade.

11. A multi-position microwave switch as set forth in claim 1 wherein each terminating resistor has a resistive center portion and opposite end conductive portions.

12. A multi-position microwave switch as set forth in claim 1 wherein each conductor blade comprises a thin elongated blade.

13. A multi-position microwave switch as set forth in claim 12 wherein said actuating means includes means for operating said blade at an intermediate position thereof.

14. A multi-position microwave switch as set forth in claim 13 further including means for biasing the blade to a resistor terminating position.

15. A multi-position microwave switch as set forth in claim 14 wherein said biasing means forces the blade against a housing wall defining said cavity to ground one side of the terminating resistor via its associated blade.

16. A multi-position microwave switch as set forth in claim 1 wherein each of said termination resistors comprises a flexible resistor having a resistive center portion and opposite end conductive portions.

17. A multi-position microwave switch as set forth in claim 16 wherein said resistor support means includes means for securing one end portion to its associated blade and disposing the other end portion over the inner conductor.

18. A multi-position microwave switch as set forth in claim 17 wherein said resistor is secured to the blade inboard of the inner conductor.

19. In a multi-position microwave switch having a housing supporting therein a first connector and spaced therefrom at least a second connector, and a selectively actuatable conductor that may be electrically conductively bridged between the connectors in a first switch position and out of bridging contact between the connectors in a second switch position, the improvement comprising, a termination impedance and associated support means for the termination impedance disposed over said second connector and adapted to support said termination impedance in either of two positions including a first positon, corresponding to said actuable conductor first switch position, in which said conductor by-passes said termination impedance, and a second position, corresponding to said conductor second switch position, in which said conductor is coupled via said termination impedance to said second connector.

20. In a multi-position microwave switch as set forth in claim 19 wherein said resistor support means includes a retainer slideably received in a recess in the inner conductor of said peripheral coaxial connector.

21. In a multi-position microwave switch as set forth in claim 20 wherein said retainer is slotted to form multiple support fingers.

22. In a multi-position microwave switch as set forth in claim 20 including a biasing spring in said recess to urge the resistor out of the recess.

23. In a multi-position microwave switch as set forth in claim 19 wherein said resistor support means includes an inner conductor portion.

24. In a multi-position microwave switch as set forth in claim 23 including a biasing means in said inner conductor portion for biasing said resistor toward its associated blade.

25. In a multi-position microwave switch as set forth in claim 19 wherein said resistor support means includes recess defining means in said inner conductor for receiving said termination resistor.

26. In a multi-position microwave switch as set forth in claim 25 including means for securing the termination resistor to its associated blade.

27. In a multi-position microwave switch as set forth in claim 19 wherein said resistor support means includes a retainer having a flat top and sloped bottom.

28. In a multi-position microwave switch as set forth in claim 27 further including a biasing spring and overlying ball for urging the resistor toward its associated blade.

29. In a multi-position microwave switch as set forth in claim 19 wherein each terminating resistor has a resistive center portion and opposite end conductive portions.

30. In a multi-position microwave switch as set forth in claim 19 wherein each conductor blade comprises a thin elongated blade.

31. In a multi-position microwave switch as set forth in claim 30 wherein said actuating means includes means for operating said blade at an intermediate position thereof.

32. In a multi-position microwave switch as set forth in claim 31 further including means for biasing the blade to a resistor terminating position.

33. In a multi-position microwave switch as set forth in claim 32 wherein said biasing means forces the blade against a housing wall defining said cavity to ground one side of the terminating resistor via its associated blade.

34. In a multi-position microwave switch as set forth in claim 19 wherein each of said termination resistors comprises a flexible resistor having a resistive center portion and opposite end conductive portions.

35. In a multi-position microwave switch as set forth in claim 34 wherein said resistor support means includes means for securing one end portion to its associated blade and disposing the other end portion over the inner conductor.

36. In a multi-position microwave switch as set forth in claim 35 wherein said resistor is secured to the blade inboard of the inner conductor.

37. In a multi-position microwave switch having a housing supporting therein a first connector and spaced therefrom at least a second connector, and a selectively actuatable conductor that may be electrically conductively bridged between the connectors in a first switch position and out of bridging contact between the connectors in a second switch position, the improvement comprising, a flexible termination impedance member having an intermediate impedance element and end conductor elements, and means for securing one of said conductor elements to said actuable conductor at a position radially displaced from over said second connector, the other of said conductor elements disposed between said second connector and actuable conductor, said flexible termination impedance member supported in either of two positions including a first position, corresponding to said actuable conductor first switch position, in which said conductor by-passes said termination impedance, and a second position, corresponding to said conductor second switch position, in which said conductor is coupled via said termination impedance to said second connector.

38. In a multi-position microwave switch as set forth in claim 37 wherein said other conductor element includes a conductive button.

39. In a multi-position microwave switch having a housing supporting therein a first connector and spaced therefrom at least a second connector, and a selectively actuable conductor that may be electrically conductively bridged between the connectors in a first switch position and out of bridging contact between the connectors in a second switch position, a method of terminating at the second connector in the unselected position of the conductor, said method comprising the steps of, providing a termination impedance, supporting the termination impedance over said second connector and supporting the termination impedance in either of two positions including a first position, corresponding to said actuable conductor first switch position, in which said conductor by-passes said termination impedance and a second position, corresponding to said conductor second switch position, in which said conductor is coupled via said termination impedance to said second connector.

40. The method of claim 39 wherein the resistors support means positions the resistor for motion of the resistor by direct contact from the actuable conductor.

41. The method as set forth in claim 40 wherein said conductor blade is in contact with said termination resistor in both said first and second switchable positions.

42. The method as set forth in claim 41 wherein said termination resistor is in contact with said inner contact with said inner conductor of said peripheral connector in both said first and second switchable positions.

43. A multi-position microwave switch as set forth in claim 1 wherein said resistor support means positions said resistor for motion of said resistor by direct contact from said conductor blade.

44. A multi-position microwave switch as set forth in claim 43 wherein said conductor blade is in contact with said termination resistor in both said first and second switchable positions.

45. A multi-position microwave switch as set forth in claim 44 wherein said termination resistor is in contact with said inner conductor of said peripheral connector in both said first and second switchable positions.

46. A multi-position microwave switch as set forth in claim 19 wherein said resistor support means positions said resistor for motion of said resistor by direct contact from said actuatable conductor.

47. A multi-position microwave switch as set forth in claim 46 wherein said actuatable conductor is in contact with said termination resistor in both said first and second switchable positions.

48. A multi-position microwave switch as set forth in claim 47 wherein said termination resistor is in contact with said second connector in both said first and second switchable positions.

* * * * *